US005612586A

United States Patent [19]

Benedikt et al.

[11] Patent Number: 5,612,586

[45] Date of Patent: Mar. 18, 1997

[54] SPARK PLUG FOR INTERNAL COMBUSTION ENGINES

[75] Inventors: Walter Benedikt, Kornwestheim; Dittmar Klett, Pleidelsheim; Dietrich Trachte, Leonberg; Hermann Kersting, Ludwigsburg; Roland Mueller, Moeglingen; Jochen Fischer, Bamberg, all of Germany

[73] Assignee: Robert Bosch GmbH, Stuttgart, Germany

[21] Appl. No.: 471,260

[22] Filed: Jun. 6, 1995

[30] Foreign Application Priority Data

Jun. 30, 1994 [DE] Germany ..... 44 22 939.9

[51] Int. Cl.[6] ..... H01T 13/20

[52] U.S. Cl. ..... 313/141; 313/123

[58] Field of Search ..... 313/141, 123

[56] References Cited

U.S. PATENT DOCUMENTS

| | | | |
|---|---|---|---|
| 1,192,003 | 7/1916 | Schmidt | 313/141 |
| 1,308,107 | 7/1919 | Perron | 313/141 |
| 2,586,864 | 2/1952 | Rose | 313/140 |
| 2,845,566 | 7/1958 | Regar | 313/141 |
| 4,484,101 | 11/1984 | Ibbott | 313/142 |
| 4,497,633 | 2/1985 | Meyer et al. | 445/7 |

FOREIGN PATENT DOCUMENTS

| | | | |
|---|---|---|---|
| 470688 | 2/1992 | European Pat. Off. | 313/141 |
| 852534 | of 1940 | France | 313/141 |
| 491837 | 9/1938 | United Kingdom | 313/141 |
| 1573445 | 8/1980 | United Kingdom | 313/141 |

*Primary Examiner*—Alvin E. Oberley
*Assistant Examiner*—Lawrence O. Richardson
*Attorney, Agent, or Firm*—Kenyon & Kenyon

[57] ABSTRACT

A spark plug for internal combustion engines ensures the formation of two spark paths. These two spark paths are a pure air spark which jumps over from electrode to electrode, and a creepage spark which emerges from the central electrode, creeps along the insulator and then jumps over at the point at the smallest distance between the insulator and the earth electrode. The spark plug includes a cylindrical metal tube which forms a housing and in which the central electrode is arranged, surrounded centrally by an insulator. The earth electrodes mounted on the metal tube are partially bent so that an obtuse bending angle of the bent-over part with respect to the part of the earth electrode which extends in the direction of the rotationally symmetrical longitudinal axis is produced.

6 Claims, 2 Drawing Sheets

SPARK PLUG FOR INTERNAL COMBUSTION ENGINES

FIELD OF THE INVENTION

The present invention relates to a spark plug for internal combustion engines.

BACKGROUND INFORMATION

A spark plug is described in European Patent No. 0 470 688. In the described spark plug, a cylindrical metal tube is provided in which a tubular ceramic insulator is arranged. This ceramic insulator projects out of the cylindrical metal tube and contains the central electrode of the spark plug, the end of the central electrode in turn peeping out of the tubular insulator. Furthermore, a multiplicity of earth electrodes which are bent over in an L shape are mounted on the cylindrical metal tube, which constitutes the housing of the spark plug. Each of these L-shaped earth electrodes consists of a vertical and a lateral part. The L shape of the earth electrodes gives rise to a bend angle of each earth electrode of 90'. Thus, the inner surface of the lateral part of each earth electrode is parallel to the surface of the insulator end.

SUMMARY OF THE INVENTION

The spark plug according to the present invention has, in contrast, the advantage that the earth electrode is less susceptible to oscillation, and thus mechanically more stable as a result of an obtuse bending angle and the associated smaller degree of deformation. Moreover, the end section of the earth electrode, which end section is assigned parallel to the outer surface of the central electrode, has a larger surface than the end section of the earth electrode with right-angled bending so that a larger spark exit surface is provided. The constructionally required distance between the mounting of the earth electrode on the housing and the point at which the earth electrode is assigned to the central electrode can be spanned, in the case of an earth electrode with an obtuse bending angle, by an earth electrode with a shorter longitudinal extent than in the case of an earth electrode with a right-angled bending angle. Consequently, the length of the earth electrode is smaller in comparison with a right-angled bending angle. Thus, less material is required.

According to the present invention, it is particularly advantageous that as a result of the ratio of the electrode spacing to the spacing between the insulator and the inside of the earth electrode facing the insulator, the formation of two spark paths is ensured and thus more reliable firing of the combustible fuel/air mixture is provided. Furthermore, it is advantageous to provide the insulator or the central electrode with a chamfer at the edge between the outer circumferential surface and the surface at the end of the insulator or the central electrode. In this way, the obliquely positioned earth electrodes can be aligned with their inner surfaces which face the insulator parallel to the surface of the chamfer on the insulator and on the central electrode. As a result, the distance between the insulator and the earth electrode can be determined very precisely.

DETAILED DESCRIPTION OF THE INVENTION

Figure 1:
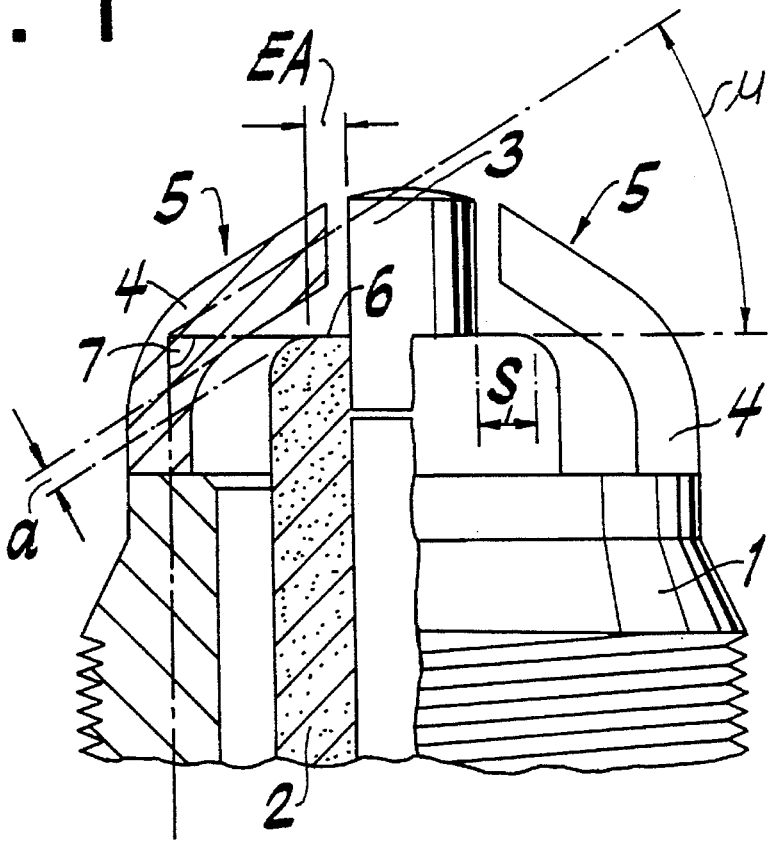
FIG. 1 shows the end section of a spark plug including the earth electrodes according to the present invention.

FIG. 1 shows a side view of an end section of the spark plug with the arrangement of the electrodes according to the present invention. For better illustration, half of the spark plug is shown in a sectional view. The spark plug includes a cylindrical metal tube 1 which forms the housing of the spark plug. In this cylindrical metal tube 1, there is a tubular insulator 2 in which the pin-shaped central electrode 3 is centrally arranged. The cylindrical metal tube 1, the insulator 2 and the central electrode 3 are assigned to one another here in such a way that their rotationally symmetrical longitudinal axes lie one on top of another.

Mounted at the end of the cylindrical metal tube 1 are at least two earth electrodes 4, the earth electrodes 4 extending initially in the direction of the cylindrical metal tube 1 and then being bent over towards the insulator and towards the central electrode. The bent-over part 5 of the earth electrodes is bent over at an obtuse angle with respect to the part of the earth electrode 4 which extends in the direction of the longitudinal axis. The angle which is enclosed by the part of the earth electrode 4 extending in the direction of the rotationally symmetrical longitudinal axis and the bent-over part 5 of the earth electrode is an angle between 100° and 150°.

In FIG. 1, the right angle which lies between the part of the earth electrode 4 which extends in the rotationally symmetrical longitudinal axis and an axis which extends axially through the bending point of the earth electrode is represented by the reference symbol 7. This right angle is the previously used bending angle. The reference symbol $\mu$ represents the angle which is still missing up to the right-angled bending angle 7. Here, $\mu$ is an angle between 10° and 60°. The obtuse bending angle is accordingly the sum of the right angle 7 and $\mu$.

The illustrated spark plug is a so-called air-surface gap spark plug, that means two spark paths are formed, one of which is an air spark and the other a creepage spark. The air spark jumps between the central electrode 3 and earth electrode 4 and the creepage spark emerges from the central electrode 3, creeps over the surface of the insulator 2 and preferably jumps over from the insulator 2 to the earth electrode 4 at the smallest distance between the insulator 2 and earth electrode 4. For the formation of two spark paths it is advantageous for the spacing EA between the central electrode 3 and the individual earth electrodes 4 to be greater than or equal to the smallest distance between the inside of the earth electrodes 4 and the insulator 2. This spacing also is referred to as gap size and is provided in FIG. 1 with the reference symbol a. This gap size a is always to be measured at the point at which the distance between the earth electrode 4 and the insulator 2 is smallest.

Furthermore, the electrode spacing is smaller than the sum of the smallest distance a between the insulator 2 and the inside of the earth electrode 4 facing the insulator 2 and the creepage path S of a creepage spark on the insulator 2.

This ensures that two spark paths can be formed, the first spark path being forced between the end section of the earth electrode 4 and the central electrode 3, and the ignition spark emerging from the central electrode 3 in the case of the second spark path, creeping over the insulator 2 and jumping over to the earth electrode 4.

Figure 2:
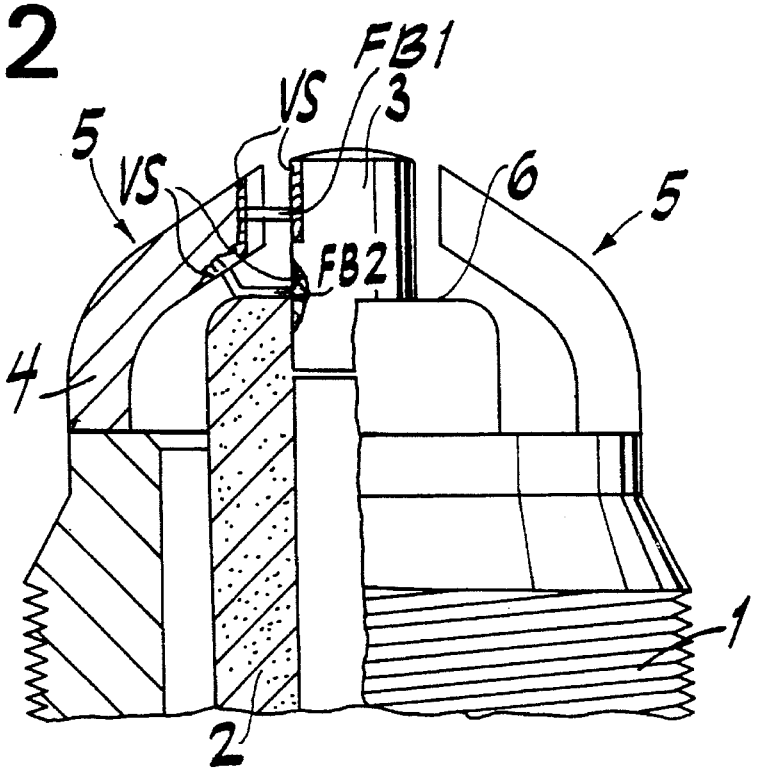
FIG. 2 shows the end section of the spark plug according to the present invention with spark paths indicated.

FIG. 2 shows the same design of the electrodes of the spark plug according to the present invention shown in FIG. 1. In this view, the spark paths and the wear zones, VS, which are formed on the spark plug are shown diagrammatically. Thus, on the one hand the ignition spark jumps over in the spark path FB1 between the individual electrodes., that is to say between the central electrode 3 and earth electrode 4. On the other hand, a second spark path FB2 is formed, in which spark path FB2 the ignition spark emerges from the central electrode 3, creeps along the insulator 2 and then jumps over to one of the earth electrodes 4. In this process, the spark will jump over from the insulator 2 to one of the earth electrodes 4 at the point at which the distance between the insulator 2 and earth electrode 4 is smallest. This distance is the gap size a so that the spark path FB2 is made up from the creepage path S over the insulator 2 and the gap size a. This spark path FB2 forms the creepage spark path. The surfaces at which the ignition spark leaves and enters the electrodes are subjected to particularly severe wear.

Figure 3:
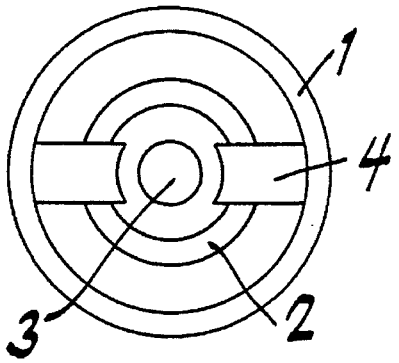
FIG. 3 shows the top view of the spark plug shown in FIG. 1.

In FIG. 3, the design of the electrodes of the spark plug according to the present invention shown in FIG. 1 is illustrated in a top view. Here, it can be seen that the end sections of the earth electrodes 4 are constructed in such a way that they are at the same distance from the central electrode 3 at all points. Thus, the end sections of the earth electrodes 4 in FIG. 3 have a circular recess.

Figure 4:
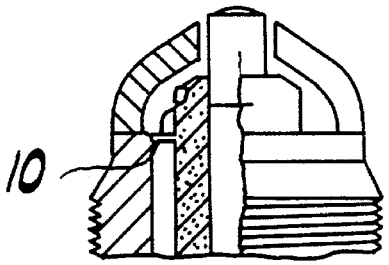
FIG. 4 shows a second embodiment of the spark plug according to the present invention.

FIG. 4 shows an arrangement of the earth electrodes 4 according to the present invention which corresponds essentially to the view in FIG. 1. The difference in relation to FIG. 1 can be seen in the illustrated side view. Here, it becomes clear that the insulator 2 has a chamfer 10 at the edge between the outer circumferential surface and the surface of the insulator. The earth electrodes 4 are positioned in such a way that the inside of the earth electrode 4 facing the insulator extends parallel to the surface of the chamfer 10 of the insulator.

Figure 5:
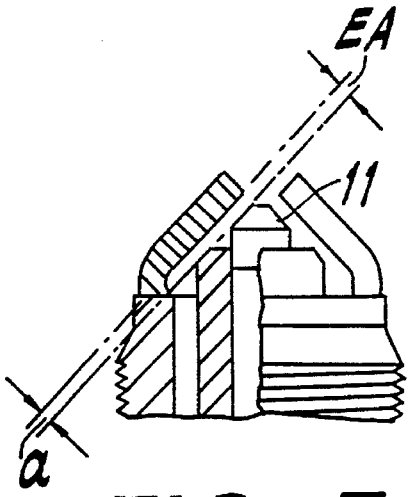
FIG. 5 shows a third embodiment of the spark plug according to the present invention.

FIG. 5 shows a third embodiment for the positioning of the earth electrodes according to the present invention. In this spark plug, as can be seen in the figure, the part of the central electrode 3 projecting out of the insulator 2 is provided with a chamfer 11 so that the central electrode 3 is pointed, a cylindrical part of the central electrode 3 still projecting out of the insulator and only part of the protruding part being provided with a chamfer. The inside of the earth electrodes 4 facing the insulator 2 and the central electrode 3 is parallel to the chamfer 10 of the insulator and to the chamfer 11 of the central electrode.

Figure 6:
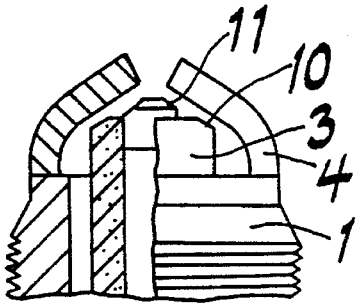
FIG. 6 shows a fourth embodiment of the spark plug according to the present invention.

FIG. 6 shows a fourth embodiment of the spark plug according to the present invention. This spark plug also is illustrated in a side view. In this spark plug, similar to the spark plug according to FIG. 5, the part of the central electrode 3 projecting out of the insulator is provided with a chamfer 11. However, the chamfer 11 extends over the entire part of the central electrode 3 which projects out of the insulator 2 so that a conical contour is produced. Here, the inside of the earth electrodes 4 facing the insulator 2 and the central electrode 3 also is parallel to the chamfer 10 of the insulator and to the chamfer 11 of the central electrode.

The electrode spacing EA is greater than or equal to the gap size a and smaller than the sum of the gap size a and the creepage path S so that the following relation applies:

$$a<EA<a+S$$

What is claimed is:

1. A spark plug for an internal combustion engine, comprising:

a cylindrical metal tube having a longitudinal opening therethrough and a first longitudinal axis;

a central electrode disposed within the opening of the cylindrical metal tube and having a second longitudinal axis;

a tubular insulator surrounding the central electrode and being disposed within the opening of the cylindrical metal tube, the tubular insulator having a third longitudinal axis, wherein the first, second and third longitudinal axes are rotationally symmetrical and congruent;

at least two earth electrodes mounted on the cylindrical metal tube, each of the at least two earth electrodes having a first portion and a second portion, the first portion extending in the direction of the rotationally symmetrical first, second and third longitudinal axes, and the second portion extending in a direction to form an angle in the range of 100° to 150° with the first portion, each of the at least two earth electrodes including an end portion facing the central electrode and defining an electrode spacing opening between the at least two earth electrodes and the central electrode for an air spark path; and wherein the tubular insulator provides a creepage path for a creepage spark from the central electrode to at least one of the at least two earth electrodes, the electrode spacing opening being at least as great as a smallest distance between an inside surface of the at least two earth electrodes and the tubular insulator and the electrode spacing opening also being less than a sum of the smallest distance and the creepage path.

2. The spark plug according to claim 1, wherein the tubular insulator includes an insulator end surface and an outer surface defining an edge therebetween, the edge having an insulation chamfer, and wherein an inside surface of the at least two earth electrodes is parallel to the insulation chamfer.

3. The spark plug according to claim 1, wherein a portion of the central electrode projects out of the tubular insulator and includes a central electrode chamfer, the central electrode extending away from the tubular insulator in a conical shape.

4. The spark plug according to claim 3, wherein an inside surface of the at least two earth electrodes extends parallel to the central electrode chamfer.

5. The spark plug according to claim 1, wherein the cylindrical metal tube has a pin-shape.

6. The spark plug according to claim 1, wherein the inside surface of the at least two earth electrodes opposes a surface of the tubular insulator.

* * * * *